US007730557B1

(12) United States Patent
Courtney et al.

(10) Patent No.: US 7,730,557 B1
(45) Date of Patent: Jun. 8, 2010

(54) COOLED PROTECTIVE GARMENT

(75) Inventors: Mark J. Courtney, Middletown, DE (US); William J. Gorak, Newark, DE (US); Gregory D. Culler, Nottingham, PA (US); Christopher S. Weyl, Newark, DE (US)

(73) Assignee: Gore Enterprise Holdings, Inc., Newark, DE (US)

( * ) Notice: Subject to any disclaimer, the term of this patent is extended or adjusted under 35 U.S.C. 154(b) by 1014 days.

(21) Appl. No.: 11/397,079

(22) Filed: Apr. 3, 2006

(51) Int. Cl.
*A62B 17/00* (2006.01)

(52) U.S. Cl. ..... 2/458

(58) Field of Classification Search ..... 2/102, 2/458, 69, 81, 93, 97, 272, 275
See application file for complete search history.

(56) References Cited

U.S. PATENT DOCUMENTS 4,816,330 A 3/1989 Freund et al. ..... 428/286
4,831,664 A 5/1989 Suda ..... 2/2
5,017,424 A 5/1991 Farnworth et al. ..... 428/230
5,263,336 A 11/1993 Kuramarohit ..... 62/259.3
5,626,947 A 5/1997 Hauer et al. ..... 428/195
6,371,977 B1 4/2002 Bumbarger et al. ..... 607/108
6,473,910 B2 11/2002 Creagan et al. ..... 2/458

FOREIGN PATENT DOCUMENTS

WO WO/92/22354 12/1992

*Primary Examiner*—Tejash Patel
(74) *Attorney, Agent, or Firm*—Dianne Burkhard

(57) ABSTRACT

A chemical protective garment or ensemble is disclosed that comprises a impermeable, protective cooling laminate having a water-holding layer for holding and evaporating liquid, and a chemical barrier. The water-holding layer has a water-holding capacity of at least about 5% wt., and the suit is designed to retain sufficient liquid to provide cooling to a wearer upon evaporation of the liquid from the suit.

70 Claims, 8 Drawing Sheets

COOLED PROTECTIVE GARMENT

BACKGROUND OF THE INVENTION

Applications for the use of chemical protective clothing include military, industrial, and emergency response personnel. Typical chemical/biological ("CB") protective clothing are designed to provide protection from liquids and/or vapors that may penetrate or permeate through the materials, seams, or interfaces between clothing components.

Industrial and emergency response chemical protective clothing is designed to provide protection from a broad class of chemicals and solvents. The primary materials of choice are impermeable materials that will provide liquid penetration and permeation resistance. There are two general classes impermeable materials—reusable and limited use or disposable products. The reusable products are typically laminates made from a combination of impermeable films, rubber layers, and/or coated textiles. Limited use or disposable protective clothing consists of outer impermeable film layers laminated to nonwoven textiles; inner film layers are used in some constructions. In both the reusable and limited use product lines, the garments possess smooth outer surfaces.

Due to the frequent use of chemical protective garments for industrial or emergency response applications, economics and safe operating practices are key selection criteria. Economics are achieved through the use of thermoplastic films laminated to nonwoven textiles, creating low-cost constructions necessary for disposable applications. For reusable applications, economics are achieved through more durable constructions that are able to maintain performance features through multiple uses. In the area of safe operating practices, garments constructed with smooth surfaces are perceived to be less likely to absorb or hold contaminated substances contacted during use in contaminated environments. It is also thought that these smooth outer surfaces are more easily cleaned or decontaminated after use.

The U.S. Environmental Protection Agency ("USEPA") has defined "Levels of Protection" ("LOP") based on the general types of respiratory protection used in various hazardous environments. These general respiratory classifications are provided by the Occupational Safety and Health Department ("OSHA") and the National Institute of Occupational Health ("NIOSH"). Each LOP includes general recommendations for protective clothing for different hazardous environments. Based on these guidelines, the protective clothing industry has developed garment systems suitable for the different LOP.

Level "A" is the highest level of respiratory and chemical protection and typically incorporates supplied air from a self-contained breathing apparatus ("SCBA"). Suits for Level A activities are commonly constructed from impermeable materials to insure hazardous chemical liquids and vapors do not come in contact with the wearer. These impermeable suits are designed to be fully encapsulating meaning that the wearer and respiratory protection are totally sealed within the impermeable envelope. The term "impermeable" is used in the chemical protective industry to refer to materials that have low chemical permeability to liquids and vapors including water. Because impermeable suit materials are water vapor impermeable, the wearer's own respiration causes moisture vapor to accumulate within the suit. Additionally during high workload activities, the temperature and humidity within an impermeable suit increases, resulting in wearer heat stress. As heat stress arises, the wearer's mental acuity and physical abilities decline making the use of such a suit limited to short duration activities. The fully encapsulating design of Level A suits trap heat from both the environment and the wearer.

Level "B" suits offer the next highest level of respiratory and chemical protection. These suits typically are constructed from impermeable materials and rely on SCBA respiratory protection. However, unlike the Level A suits, Level B suits are generally not a fully encapsulating ensemble. Often a Level B hood will be designed to allow the wearer's SCBA face piece to be external to the protective suit. Hands and feet are usually protected by gloves and booties which may optionally be detachable from the arms and legs of the suit, respectively. Because the majority of the wearer's body is still enclosed in an impermeable, encapsulating material, heat stress is still a critical issue in Level B protective ensembles. Similar to Level A suits, Level B suits trap heat from both the environment and the wearer and trap moisture vapor from the wearer.

Level "C" suits offer the next lower level of respiratory and chemical protection. Due to the lower level of protection required, Level "C" ensembles are non-encapsulating and designed for use with air-purifying respirators. These ensembles are offered in a range of materials from impermeable laminated films to impermeable textile composites.

Level "D" suits offer the lowest level of protection based on the OHSA recommendations. Level D suits are typically designed for use where there is no risk of respiratory exposure and the contact exposure risk is low.

As a result of the increasing threat of terrorism and the potential of more lethal chemical and biological hazards, emergency response personnel have been moving to ensembles offering higher levels of protection. In particular, the need for Level A and Level B ensembles has lead manufacturers to develop new and improved chemical protective materials. A first line of defense in most chemical protective materials is the outer most layer. This outer most layer is generally made of a liquid repelling material so that any liquid or aerosol chemical or biological hazards are repelled from the suit rather than being held in contact with the underlying barrier layers. For example, U.S. Pat. No. 4,816,330 (Freund) describes a multilayered chemical protective composite wherein the outer most layer is skived polytetrafluoroethylene in order to provide protection from chemical splashes. Likewise, U.S. Pat. No. 4,831,664 (Suda) provides "a body garment . . . formed from a laminate which includes a first layer of material adapted to provide contamination protection by means of an outer impermeable ply of synthetic polymeric/copolymeric plastic material." And more recently, U.S. Pat. No. 5,626,947 describes an improved multilayer chemical protective composite based on an outer most layer of a liquid repelling, polymeric resin such as a fluorocarbon or polyester film.

The layers used in these multilayer constructions are usually designed to provide chemical protection by either absorbing or resisting the permeation and penetration of the chemical threat. To insure minimal absorption of chemicals, these suits have liquid repellant outer layers. And to insure protection against permeation, conventional CB protective materials are typically thick, multi-layer composites in which each layer provides protection against certain CB threats. Panels of such composite layers are generally sealed to each other to form a sealed, impermeable ensemble.

Due to the impermeable barriers used in Level A and Level B ensembles, evaporation of sweat and heat loss from wearer's body is inhibited. Moreover, the sealed nature of these suits causes any heat and/or water vapor generated by the body to be trapped within the ensemble; thereby creating a hot and humid, uncomfortable internal environment. The inability to remove heat from the body causes a wearer to experience heat buildup and heat stress. Prolonged activity in these sealed, impermeable Level A and Level B suits regularly leads to wearer heat stress. Mild heat stress is known to reduce comfort and thereby reduce cognitive and physical performance. Severe heat stress can lead to unconsciousness and/or death. Thus, the emergence of potential events requiring extended duration, higher activity work loads for Level A and Level B chemical protective suits has created a need to remove heat from the ensemble and cool the wearer.

In an attempt to reduce heat accumulation, moisture vapor permeable, chemical protective suits have been made. PCT Patent Application No. WO92/22354 (Jarnstrom) teaches reducing heat stress of wearers of impermeable suits. To overcome heat accumulation, a permeable laminate construct is provided which allows for moisture vapor transport through the suit to eliminate heat generated by the wearer, while claiming adequate chemical protection through the use of a reactive textile polymer (is this water adsorbing also?). While this approach may help reduce the temperature and humidity of the internal suit environment, it fails to provide a cooling means useful for high output workload activities. Moreover, there is no evidence to suggest that such a permeable system would be capable of meeting the stringent chemical protection requirements for Level A or Level B ensembles where toxic industrial chemical protection is needed.

U.S. Pat. No. 5,017,424 (Farnworth) describes another chemical protective bodysuit that removes heat from the wearer by water vapor transmission through the water vapor permeable suit. As with the other existing technologies described above, Farnworth requires that all the layers be water vapor permeable for the wearer to appreciate any evaporative cooling effect.

An alternate approach to enhance cooling in a moisture vapor permeable suit is via the evaporation of liquid water from the suit surface. U.S. Pat. No. 6,473,910 (Creagan) teaches that a vest lade with an outer layer comprising a water absorbing gel. When wet with liquid water, the wearer is cooled as the absorbed liquid water evaporates from the garment surface. Likewise, U.S. Pat. No. 5,263,336 (Kuramarohit) describes an outer garment comprised of perforated tubing into which water is fed. As the liquid water flows through the tubing, it exits through perforations and wets the outer textile layer. As water evaporates off the outer textile layer, a cooling effect is appreciated by the wearer. While both of these inventions teach that evaporation of water can enhance wearer cooling to the wearer of a moisture vapor permeable suit, evaporative cooling has not been used to cool the wearers of Level A and Level B chemical protective suits described above which are designed to be moisture vapor impermeable and repel liquids.

Thus, no present technology addresses the need for a high heat loss, high chemical protection, water vapor impermeable, NFPA 1994 compliant Level A or Level B or Level C type, chemical protective ensemble. The present invention meets this unique need.

SUMMARY OF THE INVENTION

The present invention overcomes deficiencies inherent in existing, liquid repellant chemically protective suits. A multilayer, impermeable material is described herein comprising a wettable water-holding layer laminated to at least one chemical barrier layer which when formed into chemical protective ensembles that meet Level A or Level B or Level C chemical protection standards described herein. While preferred embodiments meet all of the stringent OSHA requirements, the water wettable layer is designed to retain sufficient liquid water to provide cooling to a wearer who has been wet down with liquid upon evaporation of the liquid from the suit. The level of heat transfer provided by this invention preferably enables the wearer to operate at a high activity level for longer duration than when wearing a conventional, impermeable Level A or Level B suit.

DETAILED DESCRIPTION OF THE INVENTION

Figure 1:
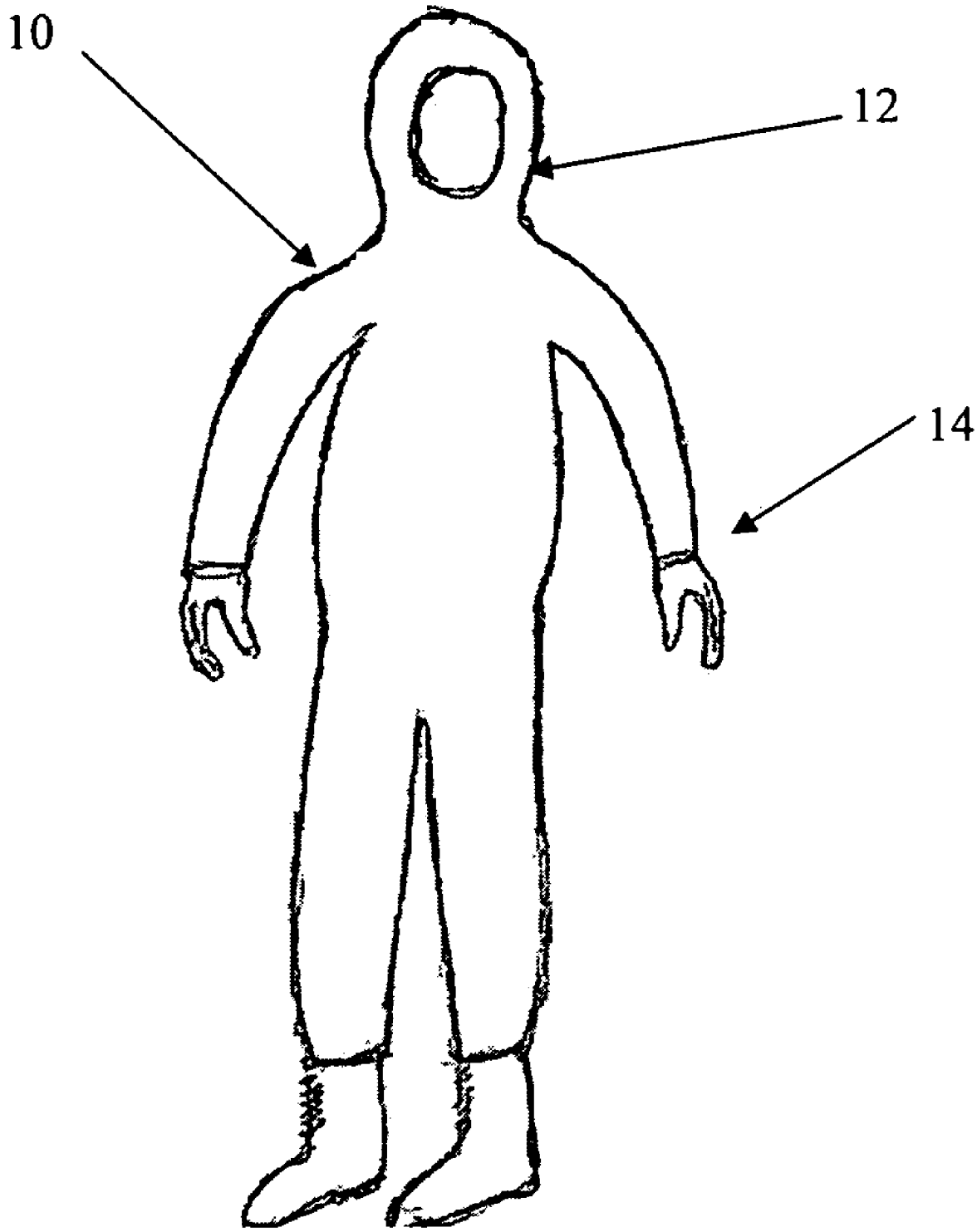
FIG. 1 is a frontal view of an exemplary Level B ensemble of the present invention.
Figure 2:
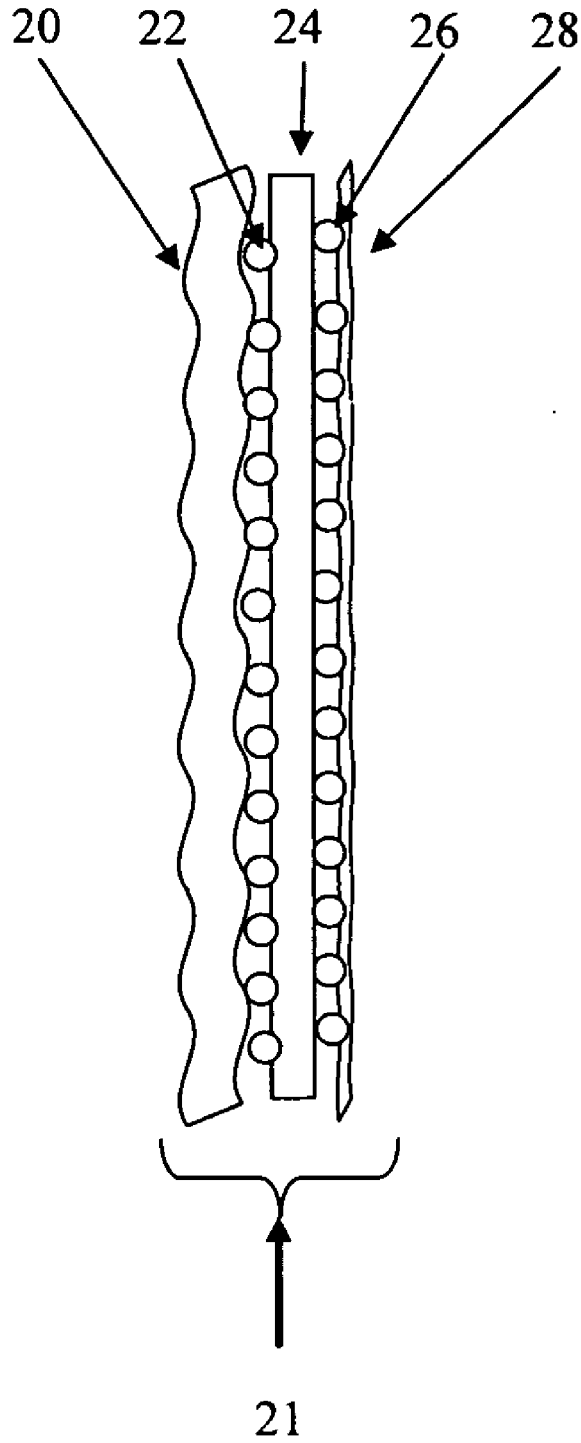
FIG. 2 is a cross-sectional view of an exemplary protective cooling laminate of the present invention with a water-holding outer layer.
Figure 3:
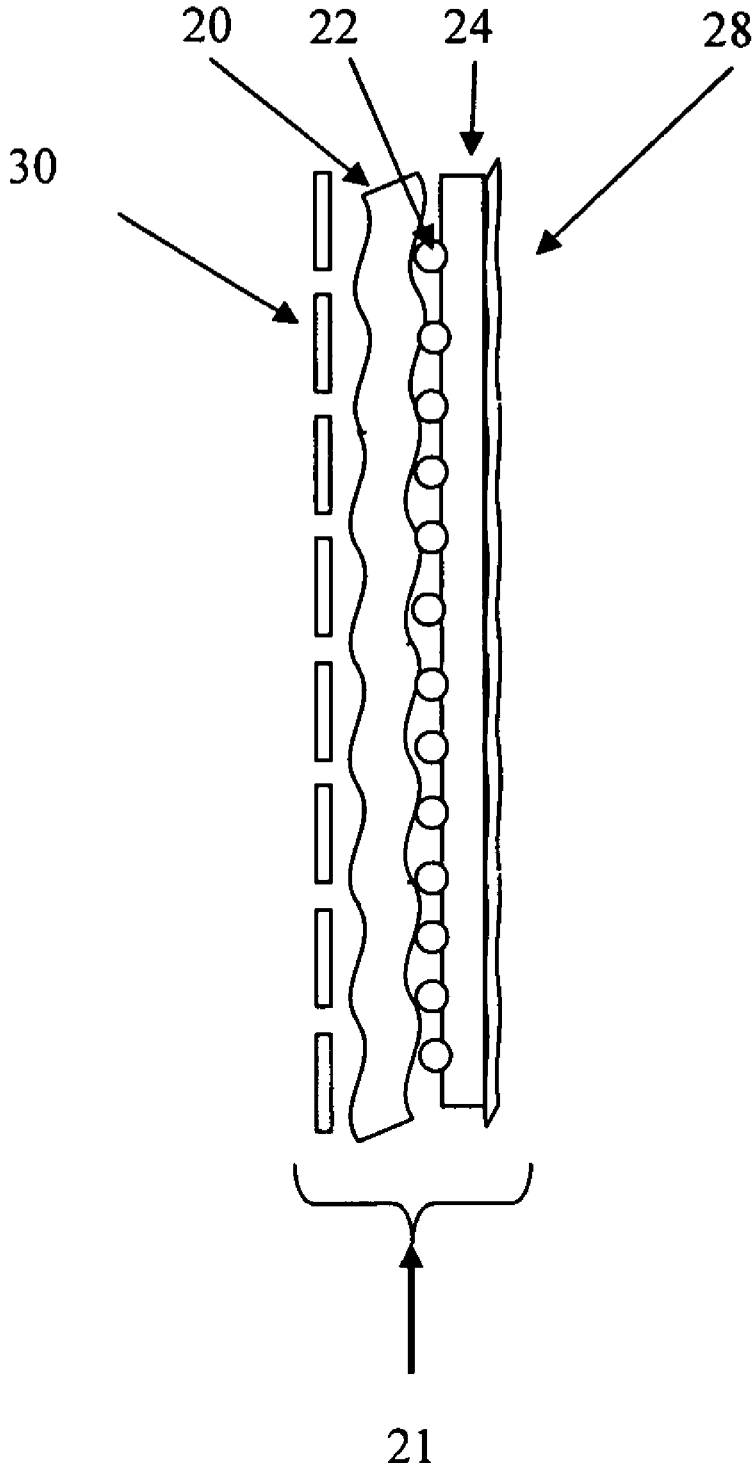
FIG. 3 is a cross-sectional view of an exemplary protective cooling laminate of the present invention with a water-holding layer located between an optional outer layer and a chemical barrier.

A chemical protective evaporative cooling garment 10 of the present invention to be worn over the body of the wearer is shown in FIG. 1. The chemical protective evaporative garment of the present invention is impermeable to both liquids and moisture vapor. The chemical protective evaporative cooling garment 10 comprises a protective cooling laminate having a hydrophilic water-holding layer for holding and evaporating water, and a chemical barrier layer impermeable to water vapor is described herein. Referring to FIGS. 2 and 3, the protective cooling laminate 21 material comprises a water-holding layer 20, an optional liner textile layer 28 proximate to the body of a wearer, and a chemical barrier layer 24 disposed between the water-holding layer and the liner textile layer 28. FIG. 2 illustrates a protective cooling laminate 21 wherein the water-holding layer 20 comprises a textile layer.

The chemical protective cooling garment 10 of the present invention holds water. As water held by the water-holding layer evaporates from the garment, heat is removed from the protective cooling laminate. This heat removal further removes heat from the wearer. Heat removed from the wearer can be measured by the evaporative resistance of clothing. The present invention provides an evaporative resistance of less than 40 $m^2$ Pa/W, preferably less than 30 $m^2$ Pa/W, more preferably less than 20 $m^2$ Pa/W, when tested and measured according to the Evaporative Resistance method described herein.

The water-holding layer 20 preferably has a water absorption greater than or equal to 5% weight, or greater than or equal to 10% weight, based on the dry weight of the protective cooling laminate 21 when tested and measured according to the method disclosed herein for Water Absorption. Also preferred are water holding layers having a water holding capacity greater than or equal to 20% wt., or greater than or equal to 30% wt., based on the dry weight of the protective cooling laminate 21, when tested and measured according to the Water Absorption method described herein.

The water-holding layer preferably comprises interstices or pores so that the liquid water can be contained therein. Suitable materials for holding and evaporating water include woven, non-woven and knit textiles, membranes, films, foams, and the like. Suitable water-holding textiles include but are not limited to nylon, cotton, polyester, cottonpoly, nylon-cotton, aramids, polybenzamidizole, Kevlar, viscose rayon, wool, and blends of these materials.

Suitable hydrophilic, non-textile materials include porous membranes, continuous foam layers, discrete foam-containing layers, and non-porous sorptive membranes. Sorptive membranes for the purpose of this invention are defined as a membrane into which liquid water either adsorbs or absorbs.

The chemical barrier layer 24 is disposed between the water holding layer 20 and a wearer of the chemical protective garment. Chemical barrier materials most suitable for use as a component in chemical and biological protective clothing are sufficiently impermeable to meet the chemical permeation requirements of NFPA 1994 Standard on Protective Ensemble for Chemical/Biological Terrorism Incidents (2001 Edition) Class 1, 2, or 3 (hereafter referred to as "NFPA 1994") and/or the chemical penetration requirements of NFPA 1992 Standard on Liquid Splash-Protective Ensembles and Clothing for Hazardous Materials Emergencies (hereafter referred to as "NFPA 1992"). In addition for some applications, suitable chemical barriers of the present invention meet NFPA 1991 Standard on Vapor-Protective Ensembles for Hazardous Materials Emergencies 2005 edition. Preferred materials for use in chemical barrier layers of the present invention are referred to as 'impermeable' for purposes of the instant invention where the material has a moisture vapor transmission rate of less than 0.04 g/(Pa $m^2$ h) when tested according to the method described herein. Further preferred are chemical barrier materials having a moisture vapor transmission rate of less than 0.02 g/(Pa $m^2$ h), or less than 0.01 g/(Pa $m^2$ h), or less than 0.006 g/(Pa $m^2$ h). Chemical barrier layers of the present invention comprise materials which include but are not limited to olefins, polyvinylidene chloride, fluoropolymers, butyl rubber, chloropolymers, EVOH, copolymers and combinations thereof. Preferred fluoropolymer materials comprise polytetrafluoroethylene.

In a further embodiment such as that depicted in FIGS. 2 and 3, a textile liner layer 28 may optionally be provided and disposed between the wearer and the chemical barrier layer 24, for example to enhance wearer comfort or to protect the chemical barrier layer. In one embodiment, the optional textile liner 28 may be hung between the chemical barrier layer 24 and the body of the wearer (FIG. 3). In an alternate embodiment, it may be attached to the chemical barrier layer 24 (FIG. 2). Suitable textile liners comprise woven, non-woven and knit textiles or any other material comprised of textile yarns.

In one embodiment of the present invention, protective cooling laminates are constructed bonding the water holding layer 20 to the chemical barrier layer 24 with an attachment means. Suitable attachment means 22 include fusion bonding, discontinuous adhesive bonding, continuous adhesive bonding, and the like. Likewise, the optional, textile liner 28 can be adhered to the chemical barrier layer 24 by any suitable attachment means such as those described above. Preferred protective cooling laminates have a thermal resistance less than or equal to 0.04 $m^2$K/W when measured according to the test method described herein. Also preferred are protective cooling laminates having a thermal resistance less than or equal to 0.03 $m^2$ K/W. Flame resistance may also be imparted to the protective cooling laminate by incorporation of flame resistant ("FR") textile and/or FR additives and/or FR adhesives.

In a further embodiment of the present invention, one or more additional layers 30 may be provided adjacent to the water-holding layer 20. These additional layers may be non-water-holding provided there exist pathways through which water can contact the water-holding layer, and be evaporated from the water-holding layer.

It is preferred that the garment or ensemble made from the protective cooling laminate of the present invention are sufficiently impermeable to meet the NFPA 1994 chemical permeation and NFPA 1992 chemical penetration requirements. The chemical protective evaporative cooling garment 10 is preferably in the form of a coverall (FIG. 1). In one embodiment of the present invention a chemical protective evaporative cooling garments 10 is provided in the form of a coverall comprising a one-piece suit which covers the head, torso, arms, and legs of a wearer, comprising the protective cooling laminate described above. Gloves and boots may be constructed of the same materials supplemented by reinforcing materials as required for the end application. The face of the wearer may be protected by a supplied air mask. In another embodiment, the chemical protective evaporative cooling garment 10 comprises a two-piece suit including pants that cover the legs and a jacket that covers the torso, arms, and optionally the head. Optionally provided is a closure means for glove and/or boot attachment, and for sealing the opening around the face for a supplied air mask.

In a separate embodiment, the present invention is directed to a chemical protective evaporative garment comprising a protective cooling laminate 21 comprising a water-holding layer 20 for holding and evaporating water wherein the water-holding layer comprises a substrate and a means for increasing the hydrophilicity of the substrate. In one embodiment, a chemical protective evaporative garment comprises a protective cooling laminate 21 comprising (a) a water-holding layer 20 comprised of a substrate and a hydrophilic coating on the substrate, and (b) a chemical barrier layer 24 impermeable to water vapor, wherein the chemical barrier layer 24 is disposed between the water-holding layer and the wearer of the garment. In this embodiment, the water-holding layer may comprise a hydrophilic or non-hydrophilic substrate, which is coated with a hydrophilic coating, for example, to increase the water-holding capacity of the water-holding layer.

To achieve a high level of evaporative cooling, a hydrophilic coating covers a sufficient portion of an underlying substrate to attain a desired water-holding capacity. Suitable coating materials include, but are not limited to polyvinyl alcohol, urethanes, polyamines, epoxies, melamine compounds, polyvinyl pyrrolidone, and electrolytic materials such as polyacrylic acid or sulfonates.

In another embodiment of the present invention where the water-holding layer comprises a means for increasing the hydrophilicity of a substrate, a chemical protective evaporative cooling garment is provided comprising a protective cooling laminate 21 comprising a water-holding layer for holding and evaporating water, wherein the water-holding layer comprises hydrophilic elements on a support substrate, or within a support substrate. The chemical protective evaporated cooling garment of this embodiment further comprises a chemical barrier layer disposed between the wearer of the chemical protective evaporative cooling garment and the water-holding layer. The water-holding layer of this embodiment comprises a support substrate for securing the hydrophilic elements in the garment. The hydrophilic elements of this embodiment may be incorporated into these support substrates by mechanical entrapment, physical adsorption, chemical bonding, coating, impregnation, or imbibing Suitable hydrophilic or water-holding elements include but are not limited to absorbent materials such as hydrogels, and super absorbers, foamed elements, natural and synthetic sponge particles, and other porous materials capable of holding water for subsequent evaporation. The support layer may be in the form of a film, membrane, foam, or textile, and suitable textile support substrate forms include woven textiles, non-woven textiles, and knits. Suitable support substrate film forms include cast films, extruded films, and blown films having hydrophilic elements contained therein. Support substrate membrane forms include membranes containing fillers or an additional continuous or co-continuous phase.

It is preferred that the water-holding capacity of a protective cooling laminate according to this embodiment is at least about 5% wt. based on the dry weight of the protective cooling laminate material when tested according to the method for Water Absorption disclosed herein. A water-holding capacity of at least about 10% wt., or 20% wt. based on the weight of the protective cooling laminate is further preferred. Chemical protective evaporative cooling garments of this embodiment are impermeable to moisture vapor having a moisture vapor transmission rate of less than 0.04 g/(Pa $m^2$h), 0.02 g/(Pa $m^2$h), or less than about 0.01 g/(Pa $m^2$h), when tested and measured according to the method disclosed herein. It is preferred that the impermeable chemical barrier layer comprises chemical barrier materials which are sufficiently impermeable to meet the chemical permeation requirements of NFPA 1994 Standard on Protective Ensemble for Chemical/Biological Terrorism Incidents (2001 Edition) Class 1, 2, or 3 (hereafter referred to as "NFPA 1994") and/or the chemical penetration requirements of NFPA 1992 Standard on Liquid Splash-Protective Ensembles and Clothing for Hazardous Materials Emergencies (hereafter referred to as "NFPA 1992"). In addition for some applications, suitable chemical barriers of the present invention meet NFPA 1991 Standard on Vapor-Protective Ensembles for Hazardous Materials Emergencies 2005 edition. Chemical barrier layers of the present invention comprise materials which include but are not limited to olefins, polyvinylidene chloride, fluoropolymers, butyl rubber, chloropolymers, EVOH, copolymers and combinations thereof.

Chemical protective evaporative cooling garments of this embodiment are preferably made in the form of a coverall having a hood and covering the head, torso, legs and arms of a wearer. Alternately, the chemical protective evaporative cooling garment of this embodiment is made in the form of an ensemble comprising at least a jacket and pants, and optionally a hood.

A method is described herein for cooling a wearer of a chemical protective garment. In one method, steps for cooling a wearer of an impermeable chemical protective garment comprise (a) providing a protective cooling laminate comprising (i) a water-holding layer for holding and evaporating water and (ii) a chemical barrier layer, (b) covering a portion of the wearer with the chemical protective garment or ensemble, disposing the chemical barrier layer between a wearer and the water-holding layer. The method further comprises (c) wetting the water-holding layer with a liquid, such as water, and (d) evaporatively removing the water from the hydrophilic layer to achieve an evaporative resistance of less than 40 $m^2$ Pa/W, preferably less than 30 $m^2$ PA/W, more preferably less than 20 $m^2$ Pa/W, when tested according to the Evaporative Resistance method described herein.

Preferably the method comprises providing a protective cooling laminate having a water-holding layer with a water absorbtion greater than or equal to 5% wt. based on the weight of the protective cooling laminate, and a moisture vapor transmission rate measured in accordance with ISO 15496 less than 0.04 g/(Pa $m^2$ h). Preferred methods comprise providing an impermeable chemical protective evaporative cooling garment in the form of a one-piece coverall or an ensemble, and substantially covering the head, torso, arms and legs of a wearer. In a further preferred embodiment, the method comprises providing a coverall or ensemble that meets the standards set forth for the chemical permeation requirements of NFPA 1994 Standard on Protective Ensemble for Chemical/Biological Terrorism Incidents (2001 Edition) Class 1, 2, or (hereafter referred to as "NFPA 1994") and/or the chemical penetration requirements of NFPA 1992 Standard on Liquid Splash-Protective Ensembles and Clothing for Hazardous Materials Emergencies (hereafter referred to as "NFPA 1992"). In addition for some applications, suitable chemical barriers of the present invention meet NFPA 1991 Standard on Vapor-Protective Ensembles for Hazardous Materials Emergencies 2005 edition.

Test Methods

Human Subject Testing

Human subject testing was conducted with a single test subject, age 19 and 125 pounds. The test protocol preparation required that the water-holding layer of the test garment be wet down with water until visibly saturated. Excess liquid water was allowed to drip from the garment prior to commencing the test protocol. Once the excess water ran off the water-holding layer, the test protocol required the subject walk about 5 kph (3.1 mph) with approximately a 2% grade on a treadmill in an environmental chamber set to about 30° C., 50% relative humidity for 60 minutes or until the subject felt it necessary to stop. Wind velocity was negligible. Skin temperature was recorded every 8 seconds at the following sites using an ACR Smart Reader 8 data logger (FLW, Inc. Costa Mesa, Calif.) left chest, right abdomen, left shoulder, right kidney, left bicep, right hamstring, and left quadricep. Mean skin temperature was determined by calculating the average of all seven measured sites for both trials. Heart rate was monitored and recorded using a Polar (Polar Inc., Lake Success, N.Y.) 610i heart rate monitor set to 15 second intervals. Sweat rate was determined by subject weight loss and water consumption based on subject naked weight taken at the beginning and end of the trial. Weight loss was determined by subtracting the end weight from the starting weight and correcting for any ingested water.

Evaporative Resistance: ASTM F2370

Evaporative resistance measurements were taken as per ASTM F2370, "Standard Test Method for Measuring the Evaporative Resistance of Clothing Using a Sweating Manikin" (September 2005 edition) in iso-thermal conditions using a sweating manikin. Option 1 was used to calculate the evaporative resistance (section 5.2.1). The only deviations from the standard ASTM F2370 test method were that the present inventive embodiments tested in Examples 1 and 2 were size medium while the comparative example was size XL. Also due to limited commercially available, Examples 1 and 2 used different designs than Comparative A. Estimations of the clothing area factor required to determine evaporative resistance was derived using ISO Method 9920 wherein all examples and comparatives were estimated using ensemble design no. 490. A clothing area factor of 1.45 was determined.

Dry Thermal Resistance: ASTM F1868: Part 1

Thermal resistance measurements were taken as per ASTM F1868: "Standard Test Method for Thermal and Evaporative Resistance of Clothing Materials Using a Sweating Hot Plate", Part 1. There were no deviations from this standard test method. Values are reported in $m^2$.K/W.

Water Vapor Permeability: ISO 15496

Water vapor permeability was performed according to ISO 15496, "Textiles—Measurement of water vapour permeability of textiles for the purpose of quality control". Water vapor permeabilities are reported in g/(Pa $m^2$ h).

Water Absorption

Water absorption testing was performed as per Federal Test Method 5504, "Water Resistance of Coated Cloth; Spray Absorption Method".of Federal Test Method Standard 191A Textile Test Method. There were no deviations from this standard test method. All samples were tested using the outer face fabric or barrier as the test surface. Water absorption results are reported as weight gain divided by dry sample weight, multiplied by 100, to obtain a percentage value.

EXAMPLES

Example 1

The cooling effect of evaporation of water from an impermeable suit system comprising a chemical protective garment made according to the present invention was tested and compared. A one-piece suit of the present invention was constructed using a Gore™ CHEMPAK® Ultra-barrier™laminate (W.L. Gore & Associates, Inc. Elkton, Md.; part number WGBZ100600D) having a 4.5 oz/$yd^2$ Nomex™ water-holding layer and a 1.8 oz/$yd^2$ Jersey knit liner textile. A chemical protective evaporative cooling garment was made in the form of a coverall covering the torso, arms, legs and head. The chemical protective garment was constructed by sewing and seam taping all seams. All closures were selected to insure minimal ingress of air or chemical agent. This suit is referred to as Example 1 in the discussion of the test results.

For purposes of testing human subjects also wore boots and gloves which overlapped the garment sleeves, and the subject's face was covered by a respirator mask. The subject wearing the suit made according to this example was wetted down in accordance with the test procedure for Human Subject Testing prior to the start of each of two tests. Skin temperature, heart rate, and sweat rate were measured as described above in the Human Subject Testing method throughout the duration of the test. The test subject walked on a treadmill at a 2% grade at about 5 kph (3.1 miles/hour) in an environmental chamber controlled to about 30° C. and about 50% relative humidity.

A comparative embodiment sample suit was tested using the same protocol as described for the suit made according to Example 1 for measuring skin temperature, heart rate and sweat rate. The Comparative Suit A was an impermeable suit constructed from a multi-layer composite film laminated to a polypropylene fabric (available from DuPont Personal Protection as CPF3, Model Number 464). The suit was also constructed in the form of a coverall and the test subject wore boots, gloves and respirator covering the face.

The Comparative Suit A was designed to repel liquids, therefore no water was retained on its surface when wetted down as per the test protocol In order to hold water on the surface of Comparative Suit A, a cotton coverall (available from McMaster Carr, part number 5372T) was worn over the suit. In the absence of the cotton coverall, Comparative Suit A would not have held any appreciable amount of water and would have shown virtually no evaporative cooling. With the cotton coverall worn over the liquid repellant Comparative Suit A, this combined ensemble was wetted down prior to the start of each of two trials. Skin temperature, heart rate, and sweat rate were measured.

Water retention of both the suit made in accordance with Example 1 and Comparative Suit A with cotton coverall was determined prior to the start of the Human Subject Testing by wetting down the suits and allowing all excess of water to drain off in accordance with the testing procedure. Standard, cool tap water from the public water supply was used for wetting both the suit made according to Example 1 and? the Comparative Suit A/coverall suit system.

Figure 4:
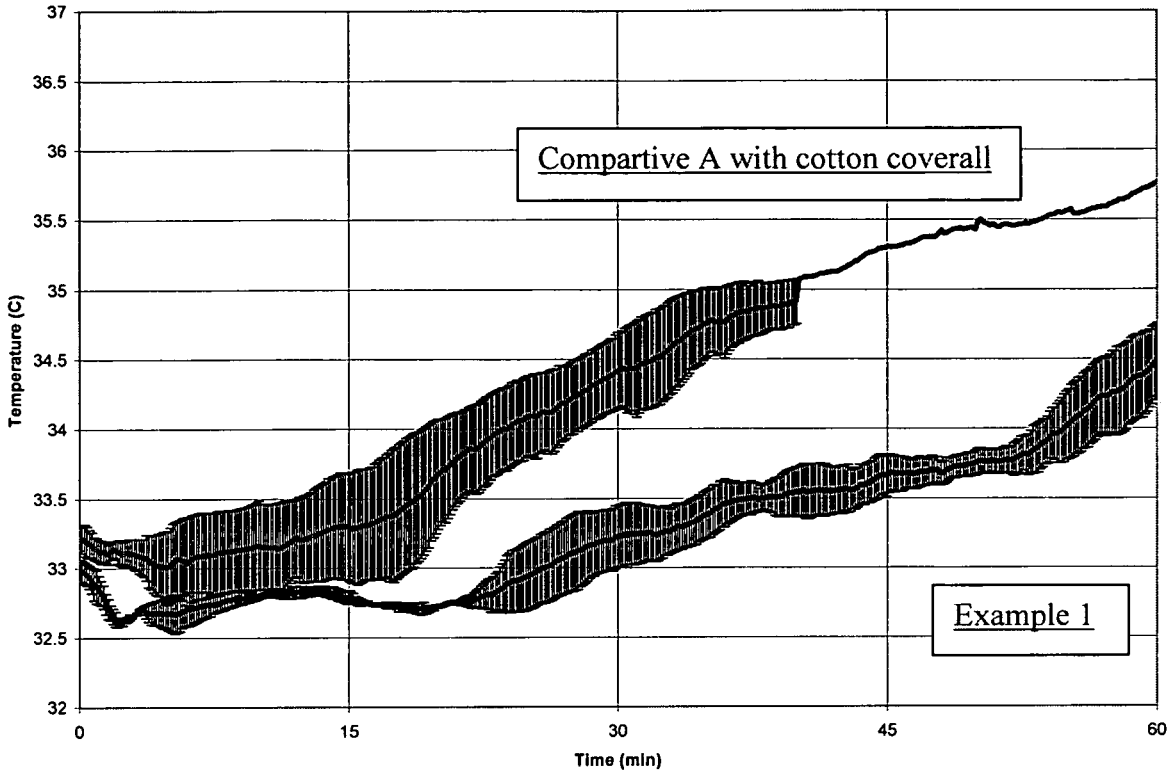
FIG. 4 is a graphical representation of mean skin temperature results of a subject wearing an embodiment of the present invention and a comparative, impermeable suit.
Figure 5:
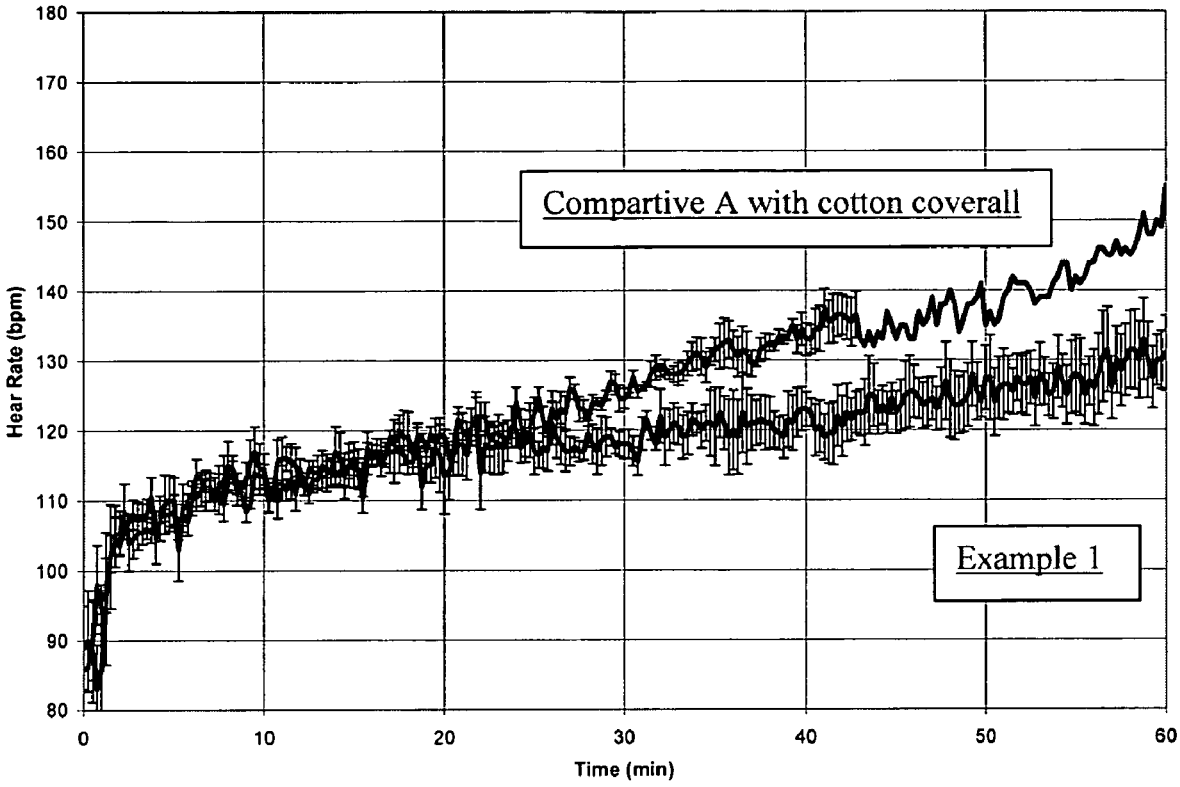
FIG. 5 is a graphical representation of average heart rate results of a subject wearing an embodiment of the present invention and a comparative, impermeable suit.
Figure 6:
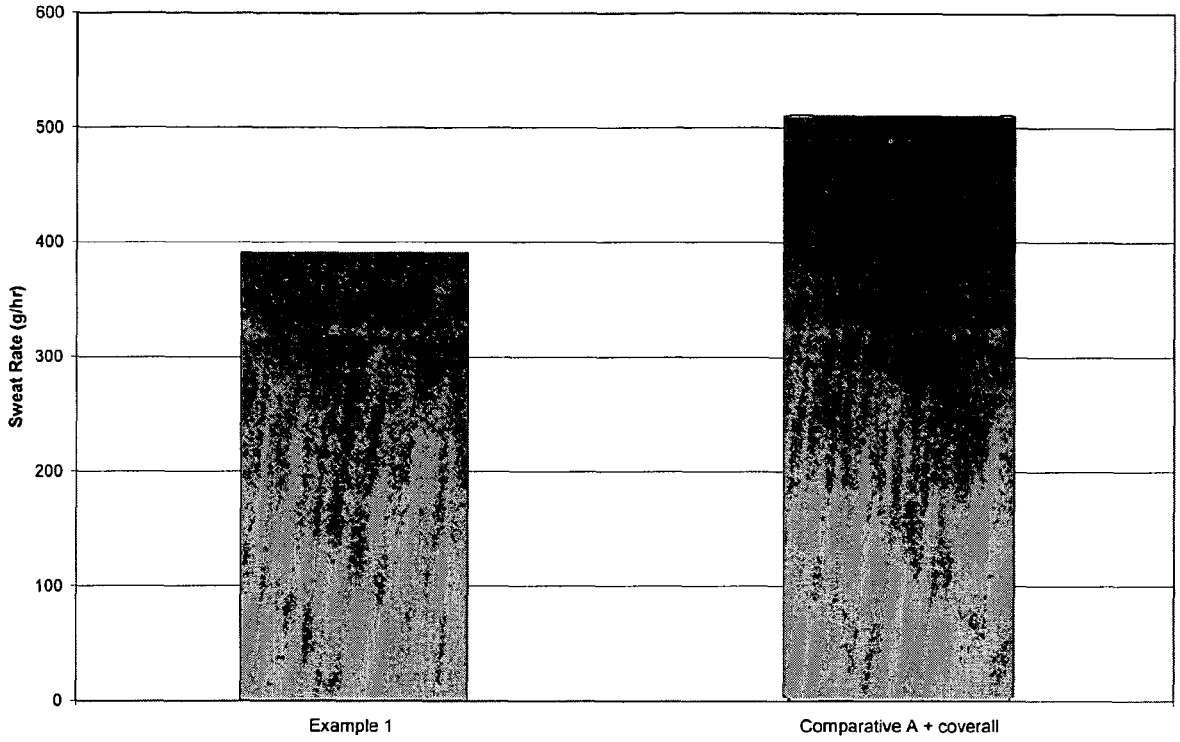
FIG. 6 is a graphical representation of average sweat rate results of a subject wearing an embodiment of the present invention and a comparative, impermeable suit.

Wetted versions of Example 1 and Comparative Suit A with the cotton coverall were tested together according to the Human Subject Testing method. The data reported in FIGS. 4, 5 and 6 are for protective ensembles in the wetted down state. Each system was tested by multiple subjects who wore both versions of the suits. As shown in FIG. 4, the measurements of a single test subject showed that the mean skin temperature of the subject when tested with the suit of Example 1 was measured to be more than about 1° C. lower than the mean skin temperature of the same subject wearing Comparative Suit A after about 40 minutes of the test protocol. Likewise, FIG. 5 shows the test subject had a heart rate that was approximately 10 beats per minute lower after about 40 minutes when wearing the suit made in accordance with Example 1 compared to Comparative Suit A with cotton coverall when tested under the same test conditions and protocol. Sweat rate for the test subject when wearing Example 1 was also found to be over 100 grams/hour lower than when the same test subject wore Comparative Suit A with cotton coverall. The data suggest that the effects of heat accumulation or heat stress was reduced when wearing the suit constructed in accordance with the present invention.

Example 2

A second embodiment of the present invention was constructed using a Gore™ CHEMPAK® Ultra-barrier™ laminate (W.L. Gore & Associates, Inc. Elkton, Md.; part number KPDX61403) having a 61 gram/$m^2$ polyester knit water-holding layer, and a nylon mesh inner textile liner. A chemical protective evaporative cooling garment was made in the form of a coverall covering the torso, arms, legs and head. The garment was constructed by sewing and seam taping all seams. All closures were selected to insure minimal ingress of air or chemical agent. This suit is referred to as suit Example 2 in the discussion of the test results.

For purposes of testing manikin testing, also wore boots and gloves which overlapped the garment sleeves, and a respirator mask.

Figure 7:
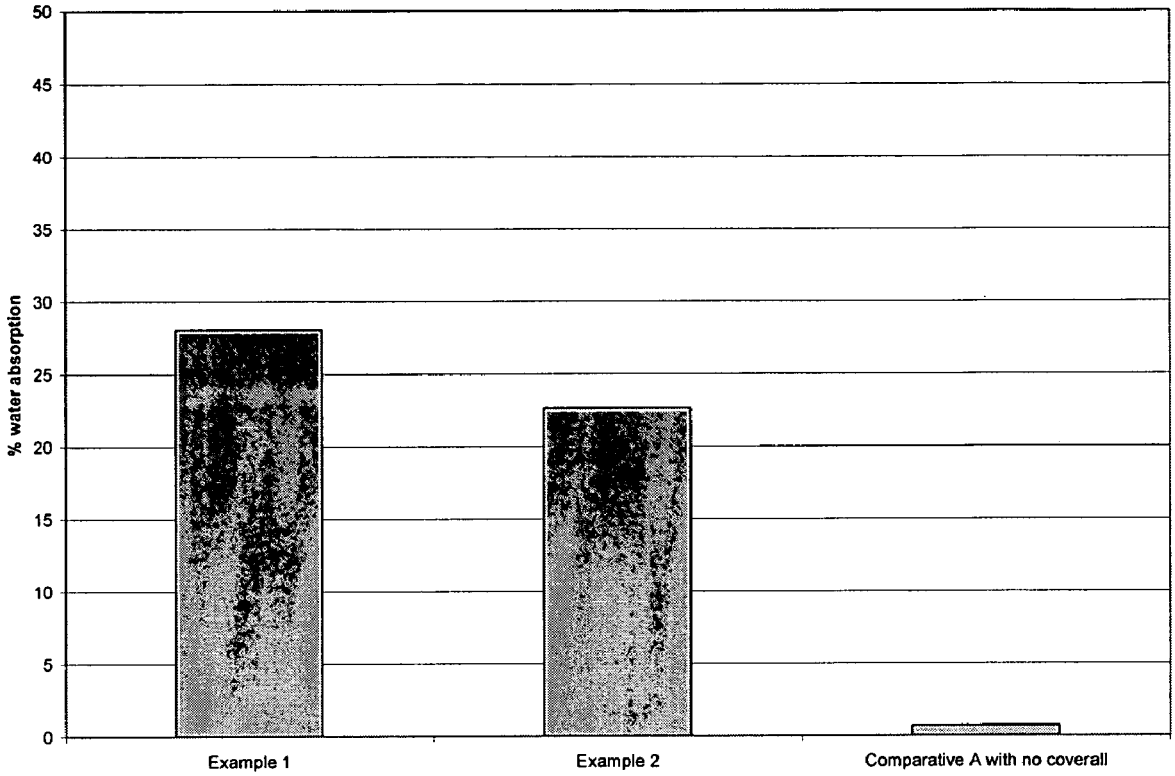
FIG. 7 is a graphical representation of percent water absorption of two embodiments based on Federal Test Method 5504.

As shown in FIG. 7, water absorption was found to be over 20% wt based on the weight of the protective cooling laminate for the materials used to prepare the suits of Examples 1 and 2 when tested and measured according to the method for Water Adsorption disclosed herein. The water absorption for the material used to make Comparative A suit without the cotton coverall was less than 2%.

Figure 8:
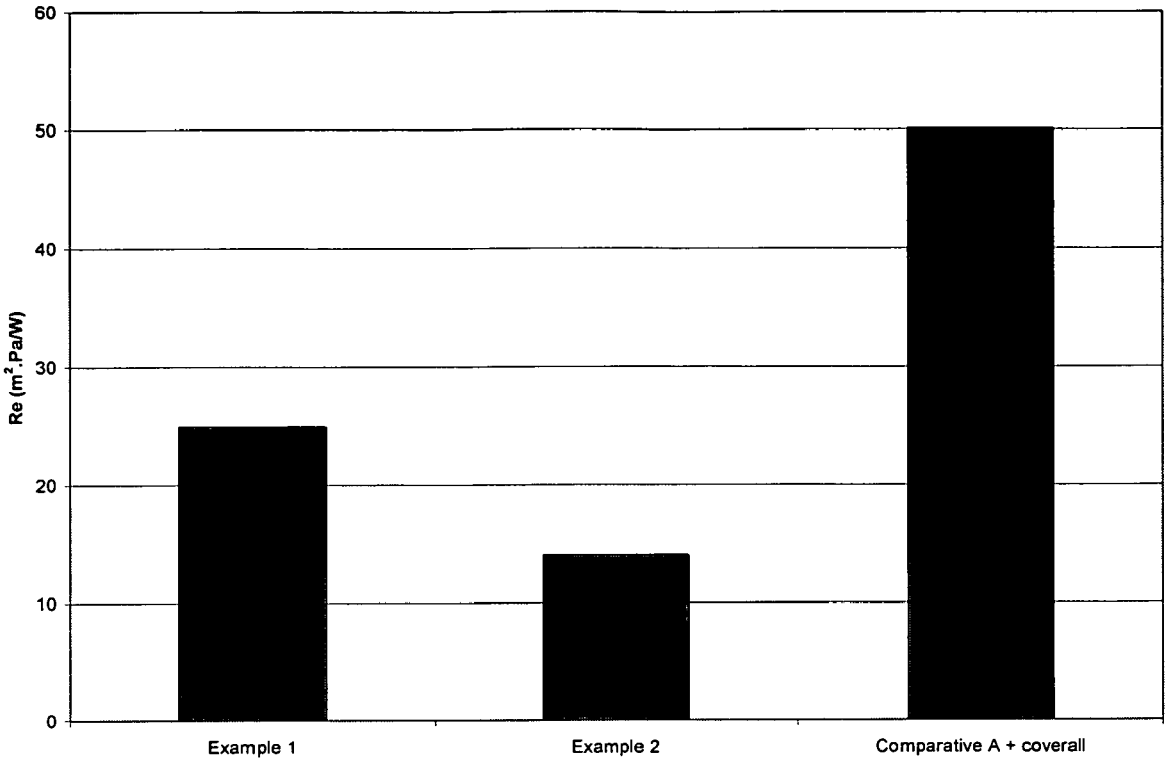
FIG. 8 is a graphical representation of evaporative resistance for two embodiments based on ASTM Test Method 2370.

FIG. 8 shows the evaporative resistance as measured by the test method describe above (ASTM F2370) for Example 1, Example 2, and Comparative Suit A with a cotton coverall. Both Example 1 and Example 2 had about a 20 $m^2$ Pa/W lower evaporative resistance than Comparative A with coverall. Lower evaporative resistance should provide reduced heat accumulation within the garment resulting in lower heat stress. Therefore under the same workload conditions, a person would be able to wear the inventive suit longer due to the reduced heat accumulation.

We claim:

1. Chemical protective garment or ensemble comprising:

a protective cooling laminate having a water absorption capacity greater than or equal to about 5% wt based on the weight of the protective cooling laminate comprising a water-holding layer for holding and evaporating water and a chemical barrier impermeable to water vapor disposed between the water holding layer and a wearer of the chemical protective garment, wherein the chemical protective garment has an evaporative resistance less than or equal to about 40 $m^2$ Pa/W, and wherein the garment or ensemble meets the chemical permeation requirements NFPA 1994 or the chemical penetration requirements of NFPA 1992, or both.

2. The garment or ensemble of claim 1 wherein the chemical protective garment has an evaporative resistance of less than or equal to about 30 $m^2$ Pa/W.

3. The garment or ensemble of claim 1 wherein the chemical protective garment has an evaporative resistance of less than or equal to about 20 $m^2$ Pa/W.

4. The garment or ensemble of claim 1 wherein the water holding layer has a water absorption capacity greater than or equal to 10% wt.

5. The garment or ensemble of claim 1 wherein the water holding layer has a water absorption capacity greater than or equal to 15% wt.

6. The garment or ensemble of claim 1 wherein the water holding layer has a water absorption capacity greater than or equal to 20% wt.

7. The garment or ensemble of claim 1 wherein the water-holding layer is a textile.

8. The garment or ensemble of claim 1 wherein the water-holding layer comprises a woven textile.

9. The garment or ensemble of claim 1 wherein the water-holding layer comprises a non-woven textile.

10. The garment or ensemble of claim 1 wherein the water-holding layer comprises a knit textile.

11. The garment or ensemble of claim 1 wherein the water-holding layer comprises porous layer.

12. The garment or ensemble of claim 11 wherein the porous layer comprises hydrophilic elements.

13. The garment or ensemble of claim 12 wherein the hydrophilic elements are particles.

14. The garment or ensemble of claim 1 wherein the protective cooling laminate is flame resistant.

15. The garment or ensemble of claim 1 wherein the protective cooling laminate has a moisture vapor transmission rate of less than about 0.04 g/(Pa $m^2$h).

16. The garment or ensemble of claim 1 wherein the protective cooling laminate has a moisture vapor transmission rate of less than about 0.02 g/(Pa $m^2$h).

17. The garment or ensemble of claim 1 wherein the protective cooling laminate has a moisture vapor transmission rate of less than about 0.01 g/(Pa $m^2$h).

18. The garment or ensemble of claim 1 wherein the protective cooling laminate has a moisture vapor transmission rate of less than about 0.006 g/(Pa $m^2$h).

19. The garment or ensemble of claim 1 wherein the water-holding layer comprises a foam.

20. The garment or ensemble of claim 1 wherein the chemical barrier layer comprises olefins, polyvinylidene chloride, fluoropolymers, butyl rubber, chloropolymers, ethylene vinyl alcohol (EVOH), and copolymers and combinations thereof.

21. The garment or ensemble of claim 1 wherein the chemical barrier comprises a fluoropolymer.

22. The garment or ensemble of claim 1 wherein the chemical barrier comprises polytetrafluoroethylene.

23. The garment or ensemble of claim 1 wherein the protective cooling laminate has a thermal resistance less than or equal to 0.04 $m^2$ K/W.

24. The garment or ensemble of claim 1 wherein the protective cooling laminate has a thermal resistance less than or equal to 0.03 $m^2$ K/W.

25. Chemical protective garment or ensemble comprising:

a protective cooling laminate having a water absorption capacity greater than or equal to about 5% wt based on the dry weight of the protective cooling laminate comprising a water-holding layer for holding and evaporating water comprising a substrate and a means for increasing the hydrophilicity of the substrate, and a chemical barrier impermeable to water vapor disposed between the water holding layer and a wearer of the chemical protective garment, wherein the chemical protective garment has an evaporative resistance less than or equal to about 40 $m^2$ Pa/W, and wherein the garment or ensemble meets the chemical permeation requirements of NFPA 1994 or the chemical penetration requirements for NFPA 1992, or both.

26. The garment or ensemble of claim 25 wherein the garment has an evaporative resistance of less than or equal to about 30 $m^2$ Pa/W.

27. The garment or ensemble of claim 25 wherein the garment has an evaporative resistance of less than or equal to about 20 $m^2$ Pa/W.

28. The garment or ensemble of claim 25 wherein the water holding layer has a water absorption capacity greater than or equal to 10% wt.

29. The garment or ensemble of claim 25 wherein the water holding layer has a water absorption capacity greater than or equal to 15% wt.

30. The garment or ensemble of claim 25 wherein the water holding layer has a water absorption capacity greater than or equal to 20% wt.

31. The garment or ensemble of claim 25 wherein the water-holding layer is a textile.

32. The garment or ensemble of claim 25 wherein the water-holding layer comprises a woven textile.

33. The garment or ensemble of claim 25 wherein the water-holding layer comprises a non-woven textile.

34. The garment or ensemble of claim 25 wherein the water-holding layer comprises a knit textile.

35. The garment or ensemble of claim 25 wherein the chemical barrier layer comprises a fluoropolymer.

36. The garment or ensemble of claim 25 wherein the protective cooling laminate has a moisture vapor transmission rate of less than about 0.04 g/(Pa $m^2$h).

37. The garment or ensemble of claim 25 wherein the protective cooling laminate has a moisture vapor transmission rate of less than about 0.02 g/(Pa $m^2$h).

38. The garment or ensemble of claim 25 wherein the protective cooling laminate has a moisture vapor transmission rate of less than about 0.01 g/(Pa $m^2$h).

39. The garment or ensemble of claim 25 wherein the protective cooling laminate has a moisture vapor transmission rate of less than about 0.006 g/(Pa $m^2$h).

40. The garment or ensemble of claim 25 wherein the water-holding layer comprises a porous material.

41. The chemical protective garment or ensemble of claim 25 wherein the means for increasing the hydrophilicity of the substrate comprises a hydrophilic coating on the substrate.

42. The chemical protective garment or ensemble of claim 26 wherein the coating comprises at least one material selected from polyvinyl alcohol, urethanes, polyamines, epoxies, melamine compounds, polyvinyl pyrrolidone, and electrolytic materials such as polyacrylic acid and sulfonates.

43. The chemical protective garment or ensemble of claim 25 wherein the means for increasing the hydrophilicity of the substrate comprises hydrophilic elements.

44. The chemical protective garment or ensemble of claim 25 wherein the hydrophilic elements comprise porous elements for holding water.

45. The chemical protective garment or ensemble of claim 25 wherein the hydrophilic elements comprise foams.

46. Chemical protective garment comprising:

a coverall having hood, the coverall covering the head, torso, arms and legs of a wearer comprising a protective cooling laminate having a water absorption capacity greater than or equal to about 5% wt based on the protective cooling laminate weight comprising a water-holding layer for holding and evaporating water, and a chemical barrier impermeable to water vapor, wherein the chemical barrier is disposed between the water holding layer and a wearer of the chemical protective garment, and wherein the protective cooling laminate has a moisture vapor transmission rate of less than about 0.01 g/(Pa $m^2$h).

47. The garment of claim 46 wherein the chemical protective garment has an evaporative resistance of less than or equal to about 40 $m^2$ Pa/W.

48. The garment of claim 46 wherein the chemical protective garment has an evaporative resistance of less than or equal to about 30 $m^2$ Pa/W.

49. The garment of claim 46 wherein the water holding layer has a water absorption capacity greater than or equal to 10%.

50. The garment of claim 46 wherein the water holding layer has a water absorption capacity greater than or equal to 15%.

51. The garment of claim 46 wherein the water holding layer has a water absorption capacity greater than or equal to 20%.

52. The garment of claim 46 wherein the water-holding layer is a textile.

53. The garment of claim 46 wherein the water-holding layer comprises a woven textile.

54. The garment of claim 46 wherein the water-holding layer comprises a non-woven textile.

55. The garment of claim 46 wherein the water-holding layer comprises a knit textile.

56. The garment of claim 46 wherein the chemical barrier layer comprises a fluoropolymer.

57. The garment of claim 46 wherein the protective cooling laminate has a moisture vapor transmission rate of less than about 0.006 g/(Pa $m^2$h).

58. The garment of claim 46 wherein the water-holding layer comprises a porous material.

59. A method of cooling a wearer of a chemical protective garment or ensemble comprising a. providing a chemical protective garment comprising a protective cooling laminate comprising i. a water-holding layer for holding and evaporating water having a water absorption greater than or equal to 5% wt and ii. a chemical barrier impermeable to moisture vapor, b. covering the wearer with the chemical protective garment and disposing the chemical barrier between a wearer and the water-holding layer c. wetting the water-holding layer with liquid water, and d. evaporatively removing the water from the water-holding layer to achieve an evaporative resistance of less than 40 $m^2$ Pa/W.

60. The method of claim 59 comprising achieving an evaporative resistance of less than 30 $m^2$ Pa/W.

61. The method of claim 59 comprising achieving an evaporative resistance of less than 20 $m^2$ Pa/W.

62. The method of claim 59 wherein the water-holding layer is a textile.

63. The method of claim 59 wherein the water-holding layer woven.

64. The method of claim 59 wherein the water-holding layer is non-woven.

65. The method of claim 59 wherein the water-holding layer is a knit.

66. The method of claim 59 wherein the protective cooling laminate has a moisture vapor transmission rate of less than about 0.04 g/(Pa $m^2$h).

67. The method of claim 59 wherein the protective cooling laminate has a moisture vapor transmission rate of less than about 0.02 g/(Pa $m^2$h).

68. The method of claim 59 wherein the protective cooling laminate has a moisture vapor transmission rate of less than about 0.01 g/(Pa $m^2$h).

69. The method of claim 59 wherein the protective cooling laminate has a moisture vapor transmission rate of less than about 0.006 g/(Pa $m^2$h).

70. The method of claim 59 wherein the water-holding layer comprises a porous material.

* * * * *